US008274229B2

(12) United States Patent
Yang

(10) Patent No.: US 8,274,229 B2
(45) Date of Patent: Sep. 25, 2012

(54) REVERSE POLARITY SERIES TYPE LED AND DRIVE CIRCUIT

(76) Inventor: Tai-Her Yang, Dzan-Hwa (TW)

( * ) Notice: Subject to any disclaimer, the term of this patent is extended or adjusted under 35 U.S.C. 154(b) by 334 days.

(21) Appl. No.: 12/648,354

(22) Filed: Dec. 29, 2009

(65) Prior Publication Data

US 2011/0049993 A1 Mar. 3, 2011

Related U.S. Application Data

(63) Continuation-in-part of application No. 12/548,610, filed on Aug. 27, 2009.

(51) Int. Cl.
*H05B 37/00* (2006.01)

(52) U.S. Cl. ..... 315/185 R; 315/185 S; 315/201; 315/205; 362/249.06; 362/800

(58) Field of Classification Search ..... 315/291, 315/299, 360, 185 R, 192, 200 R, 312, 187, 315/205, 246, 207, 206, 200 A, 324; 362/227, 362/230, 231, 234, 235, 236, 237, 240, 252, 362/569, 810, 807, 812, 808
See application file for complete search history.

(56) References Cited

U.S. PATENT DOCUMENTS

| | | | | |
|---|---|---|---|---|
| 5,688,042 | A * | 11/1997 | Madadi et al. | 362/240 |
| 5,726,535 | A * | 3/1998 | Yan | 315/185 R |
| 5,806,965 | A * | 9/1998 | Deese | 362/249.04 |
| 6,461,019 | B1 * | 10/2002 | Allen | 362/249.06 |
| 7,250,730 | B1 * | 7/2007 | Allen | 315/185 R |
| 7,276,858 | B2 * | 10/2007 | Allen | 315/205 |
| 2007/0063657 | A1 * | 3/2007 | Wu | 315/205 |
| 2008/0157686 | A1 * | 7/2008 | Chung et al. | 315/185 S |
| 2009/0224688 | A1 * | 9/2009 | Yang | 315/291 |

* cited by examiner

*Primary Examiner* — Shawki Ismail
*Assistant Examiner* — Christopher Lo
(74) *Attorney, Agent, or Firm* — Bacon & Thomas, PLLC

(57) ABSTRACT

The present invention of a reverse polarity series type LED is formed by two sets of LED and diode assemblies in reverse polarity series connection wherein the first set is consisted of at least one or multiple homopolar series or parallel connected or series and parallel connected LEDs, and the second set consisting of at least one or more homopolar parallel or series connected or series and parallel connected LEDs for further connection to the drive circuit formed by current-limiting impedance and/or power storage and discharging devices and/or voltage-limit circuit devices in order to produce the required operational characteristics.

11 Claims, 5 Drawing Sheets

REVERSE POLARITY SERIES TYPE LED AND DRIVE CIRCUIT

CROSS-REFERENCE TO RELATED APPLICATION

This application is a Continuation-In-Part of my patent application, Ser. No. 12/548,610, filed on Aug. 27, 2009.

BACKGROUND OF THE INVENTION (a) Field of the Invention

The present invention relates to a reverse polarity series type LED and drive circuit that feature the use of direct current or alternating current power source by means of the selection of pins.

(b) Description of the Prior Art

Currently LEDs are divided into direct current electric energy drive and alternating current LED which is driven by alternating current through reverse polarity parallel connection of LEDs. Their usages are relatively inflexible.

SUMMARY OF THE INVENTION

The present invention of a reverse polarity series type LED is formed by two sets of LED and diode assemblies in reverse polarity series connection wherein the first set is consisted of at least one or multiple homopolar series or parallel connected or series and parallel connected LEDs, and the second set consisting of at least one or more homopolar parallel or series connected or series and parallel connected LEDs for further connection to the drive circuit formed by current-limiting impedance and/or power storage and discharging devices and/or voltage-limit circuit devices in order to produce the required operational characteristics.

DESCRIPTION OF MAIN COMPONENT SYMBOLS (101), (102): LED (201), (202), (203), (204): Diodes (301), (302): Power storing and discharging devices (400), (401), (402): Current-limiting impedance elements (501), (502): Voltage-limiting elements a terminal: Independent terminal of the first. LED and diode assembly connection.

b terminal: Reverse series connection terminal of the first and second LED and diode assemblies.

c terminal: Independent terminal of the second LED and diode assembly connection.

DETAILED DESCRIPTION OF THE PREFERRED EMBODIMENTS

Currently LEDs are divided into direct current electric energy drive and alternating current LED which is driven by alternating current through reverse polarity parallel connection of LEDs. Their usages are relatively inflexible.

The present invention relates to a reverse polarity series type LED and drive circuit that feature the use of direct current or alternating current power source by means of the selection of pins.

The present invention of a reverse polarity series type LED is formed by two sets of LED and diode assemblies in reverse polarity series connection wherein the first set is consisted of at least one or multiple homopolar series or parallel connected or series and parallel connected LEDs, and the second set consisting of at least one or more homopolar parallel or series connected or series and parallel connected LEDs for further connection to the drive circuit formed by current-limiting impedance and/or power storage and discharging devices and/or voltage-limit circuit devices in order to produce the required operational characteristics.

Figure 1:
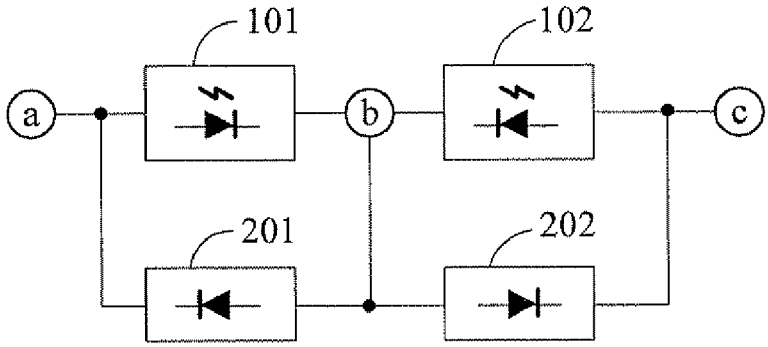
FIG. 1 is the circuit diagram of the reverse polarity series type LED of the present invention.

The main formation of the reverse polarity series type LED and drive circuit are the following:

FIG. 1 is the circuit structural diagram of the reverse polarity series LED of the present invention;

The main formation of FIG. 1 includes:

LED (101): Formed by one or more luminous diodes in homopolar parallel or series connection or in series and parallel connection.

LED (102): Formed by one or more luminous diodes in homopolar parallel or series connection or in series and parallel connection.

Diodes (201), (202): Formed by one or more rectified diode or single way conductive circuit devices in parallel or series connection or in series and parallel connection.

By means of parallel connection between the LED (101) and the diode (201) in the reciprocal turn-on current direction, the first set of LED and diode assembly is formed. And by means of the parallel connection between the LED (102) and the Diode (202) in the reciprocal turn-on current direction, the second LED and diode assembly is formed.

By means of the reverse polarity series connection between the first LED and diode assembly with the second LED and diode assembly, a reverse polarity series type LED device is formed; wherein the independent connection terminal of the first LED and diode assembly is designated as the (a) terminal, and the reverse polarity series connection terminal between the first and the second LED and diode assemblies is designated as the (b) terminal. The independent connection terminal of the second LED and diode assembly is designated as the (c) terminal.

Figure 2:
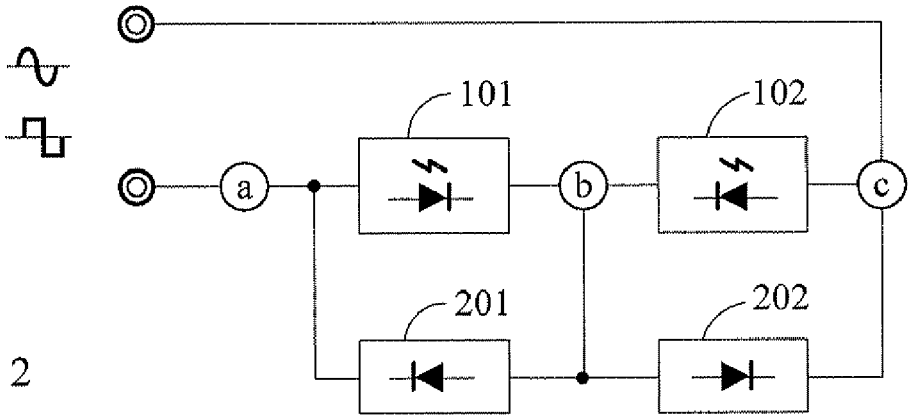
FIG. 2 is the circuit diagram of the present invention as applied on the alternating current power source and connected in series with the impedance elements.
Figure 3:
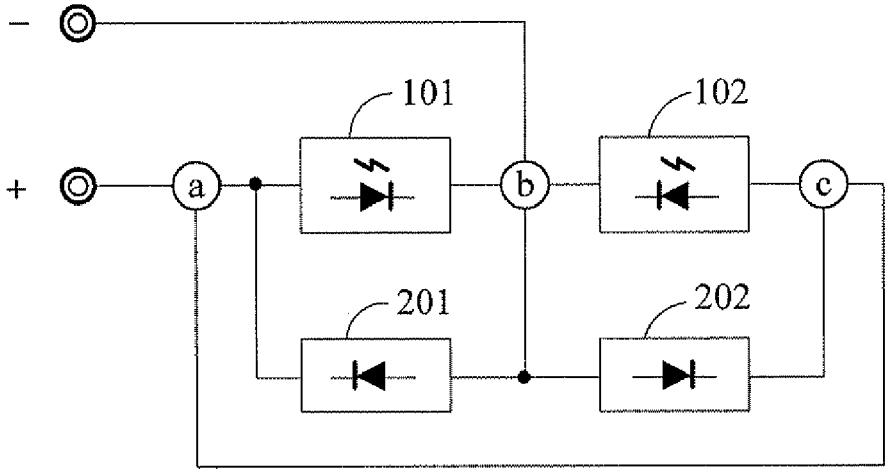
FIG. 3 is the circuit diagram of the reverse polarity series type LED as applied on the direct current power source.

When alternating current power is delivered from the (a) and (c) terminals of the reverse polarity series type LED, the reverse polarity series type LED device serves to perform the functions of the alternating current LED. FIG. 2 shows the circuit diagram of the reverse polarity series type LED as applied on alternating current power; or When the (a) and (c) terminals of the reverse polarity series type LED are connected to each other, their connection terminal and (b) terminal serve to commonly allow direct current to pass through LED (101) and LED (102) so that the reverse polarity series type LED device serves to perform the functions of a direct current LED. FIG. 3 shows the circuit diagram of the reverse polarity series type LED as applied on the direct current power.

When the reverse polarity series type LED and drive circuit are applied on the alternating current power, a current-limiting impedance element (400) is series connected to the (a) or (c) terminals of the alternating current power and the reverse polarity series type LED and/or a current-limiting impedance element (401) is series connected to LED (101) and/or a current-limiting impedance element (402) is series connected to the LED (102).

Figure 4:
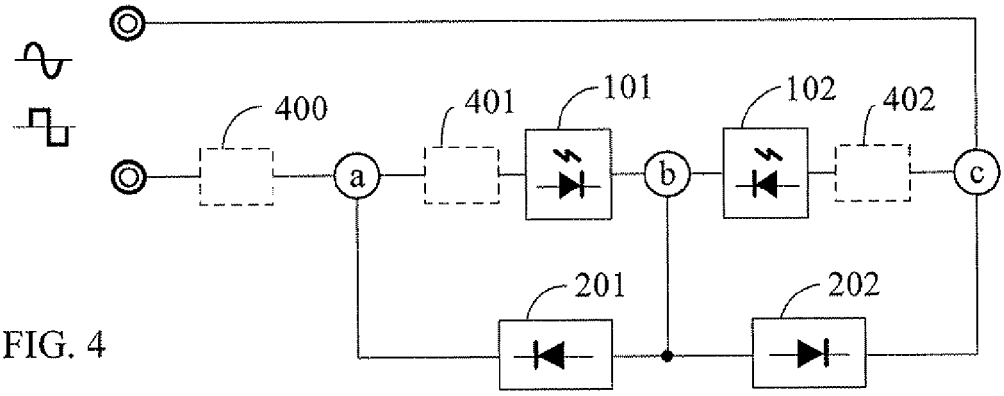
FIG. 4 is the circuit diagram of the reverse polarity series type LED as applied on the alternating current power source wherein the LEDs are first connected in series with the impedance elements, and then connected in parallel with the diodes.

FIG. 4 is the circuit diagram of the reverse polarity series type LED of the present invention being applied on alternating current power wherein the LEDs are connected in series with the impedance elements, and then connected in parallel with the diodes.

As shown in FIG. 4, the impedance elements are formed by one or more impedance element types including: 1) resistive impedance element 2) conductive impedance elements 3) inductive impedance elements 4) linear transistor impedance elements 5) clipping on-off type elements formed by solid on-off type elements 6) thyristor clipping on-off elements.

The series positions of the impedance elements include: 1) the impedance element is connected in series with individual LED afterwhich it connects in parallel with diodes; and/or 2) the impedance element is connected in series between the power source and the reverse polarity series type LED; and/or 3) the LED connects to the diode in parallel and then connects to the impedance element in series.

When the reverse polarity series type LED and drive circuit are applied on the direct current power, a current-limiting impedance element (400) is series-connected with the connection terminal of the direct current power and the reverse polarity series type LED (a) and (c) terminals or with (b) terminal and/or a current-limiting impedance element (401) is series-connected to the LED (101) and/or a current-limiting impedance element (402) is series connected to the LED (102).

Figure 5:
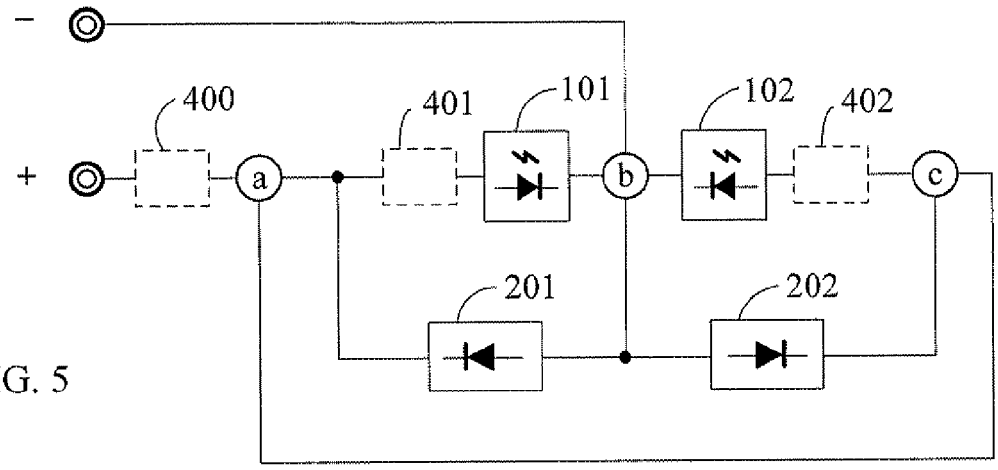
FIG. 5 is the circuit diagram of the reverse polarity series type LED of the present invention as applied on the direct current power source wherein the LEDs are first connected in series with impedance elements, and then connected in parallel with the diodes.

FIG. 5 is a circuit diagram of the reverse polarity series type LED being applied on the direct current power source wherein the LED's are first connected in series with the impedance elements, and then connected in parallel with the diodes.

As shown in FIG. 5, the impedance elements formed by one or more impedance element types including: 1) resistive impedance element; 2) linear transistor impedance elements; 3) clipping on-off type elements formed by solid on-off type elements; 4) thyristor clipping on-off elements.

The series positions of the impedance elements include: 1) the impedance element is connected in series with individual LED afterwhich it connects in parallel with diodes; and/or 2) the impedance element is connected in series between the power source and the reverse polarity series type LED; and/or 3) the LED connects to the diode in parallel and then connects to the impedance element in series.

When the reverse polarity series type LED and drive circuit are applied on the alternating current power, a current-limiting impedance element (400) is series connected to the (a) or (c) terminals of the alternating current power and the reverse polarity series type LED and/or a current-limiting impedance element (401) is series connected to LED (101) and/or a current-limiting impedance element (402) is series connected to the LED (102), and the both terminals of diode (201) is parallel-connected to the power storing and discharging device (301) and/or the both terminals of diode (202) is parallel-connected to the power storing and discharging device (302). Their polarities during the delivery of alternating current power are such that they assume a power supply status with respect to the LED with which they are connected in parallel. When the power supply voltage is higher than the voltage of its parallel-connected power storing and discharging device, the power source simultaneously supplies power to the LED and charges the power storing and discharging device with which it is connected in parallel. The polarities of the alternating current power supply do not supply power to its parallel-connected LED. When the power supply voltage is lower than the voltage of the power storing and discharging device, the power storing and discharging device will supply power to the LED with which it is connected in parallel.

Figure 6:
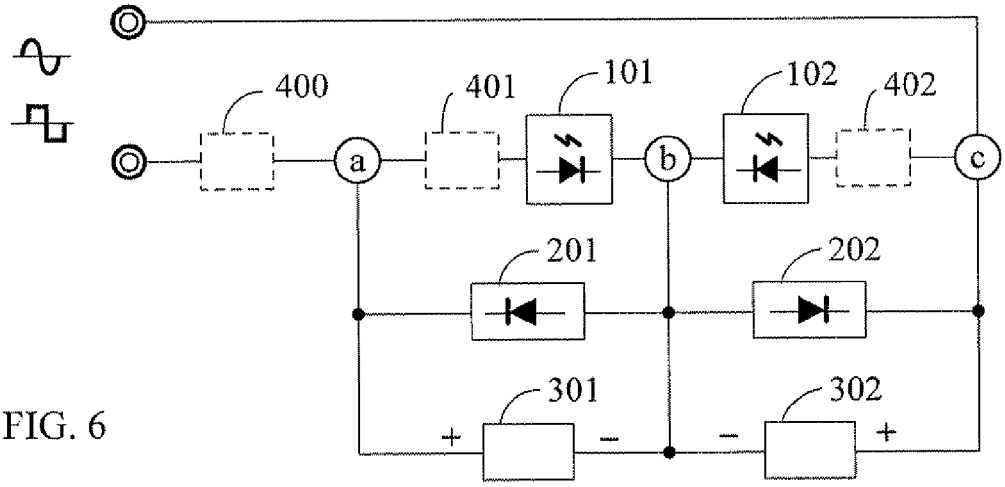
FIG. 6 is the circuit diagram of the reverse polarity series type LED of the present invention as applied on the alternating current power source wherein the LEDs are first connected in series with the current-limiting impedance element, and then connected in parallel with both the power storing and discharging device and the diodes.

By means of the operation of the power storing and discharging device, the following partial or complete functions are attained: 1) enables two LEDs to deliver power and emit light without being affected by the polarity changes of the alternating current power source; 2) when alternating current power is driving the LED, optical pulsation of the LED is reduced; 3) supplies delay electric energy for LED when power is cut off; 4) serves as power supply to allow continuous lighting of LEDs during an emergency power shutdown. The power storing and discharging device is consisted of a rechargeable battery or a monopolar or bipolar capacitance or super capacitance; FIG. 6 is the circuit diagram of the reverse polarity series type LED as applied on alternating current power wherein the LEDs are first connected in series with the impedance elements, and then connected in parallel with the power storing and discharging devices, and with the diodes.

When the reverse polarity series type LED and drive circuit are applied on the alternating current power, a current-limiting impedance element (400) is series connected to the (a) or (c) terminals of the alternating current power and the reverse polarity series type LED and/or a current-limiting impedance element (401) is series connected to LED (101), and according to the direction of the light-emitting current of LED (101), it is connected in series with diode (203), then through the current input terminal of diode (203) and the current output terminal of LED (101), it assumes a reverse current flow and connects in parallel with diode (201) and/or a current-limiting impedance element (402) is series-connected to LED (102), and according to the direction of light-emitting current, it is connected in series to diode (204), and then through the current input terminal of diode (204) and the current output terminal of LED (102), it assumes a reverse current flow and connects in parallel with diode (202), a power storing and discharging device (301) is connected in parallel between the joint connecting diode (203) and the current-limiting impedance element (401) and the current output terminal of LED (101), and/or a power storing and discharging device (302) is connected in parallel between the joint connecting diode (204) and current-limiting impedance element (402) and the current output terminal of LED (102). Their polarities during the delivery of alternating current power are such that they assume a power supply status with respect to the LED with which they are connected in parallel. When the power supply voltage is higher than the voltage of its parallel-connected power storing and discharging device, the power source simultaneously supplies power to the LED and charges the power storing and discharging device with which it is connected in parallel. The polarities of the alternating current power supply do not supply power to its parallel-connected LED. When the power supply voltage is lower than the voltage of the power storing and discharging device, the power storing and discharging device will supply power to the LED with which it is connected in parallel.

Figure 7:
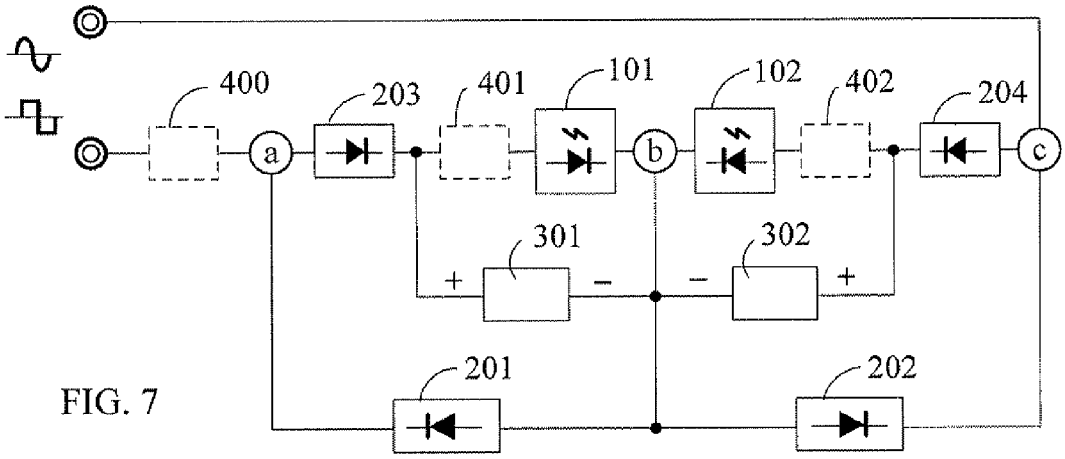
FIG. 7 is the circuit diagram of the reverse polarity series type LED as applied on the alternating current power source wherein the LEDs are first connected in series with the current-limiting elements and then connected in parallel with the power storing and discharging devices, and then connected in series with the blocking diodes, and finally are connected in parallel with the diodes.

By means of the operation of the power storing and discharging device, the following partial or complete functions are attained: 1) enables two LEDs to deliver power and emit light without being affected by the polarity changes of the alternating current power source; 2) when alternating current power is driving the LED, optical pulsation of the LED is reduced; 3) supplies delay electric energy for LED when power is cut off; 4) serves as power supply to allow continuous lighting of LEDs during an emergency power shutdown. The power storing and discharging device is consisted of a rechargeable battery or a monopolar or bipolar capacitance or super capacitance; FIG. 7 is the circuit diagram of the reverse polarity series type LED as applied on alternating current power wherein the LEDs are first connected in series with the current-limiting elements and then connected in parallel with the power storing and discharging devices, and then connected in series with the blocking diodes, and finally are connected in parallel with the diodes.

In the operational diagram of FIG. 6 and FIG. 7 wherein the reverse polarity series type LED is applied on the alternating current power and parallel-connected to a power storing and discharging device, the current-limiting impedance element (400), and/or the current-limiting impedance element (401) and/or the current-limiting impedance element (402) are optionally installed.

Figure 8:
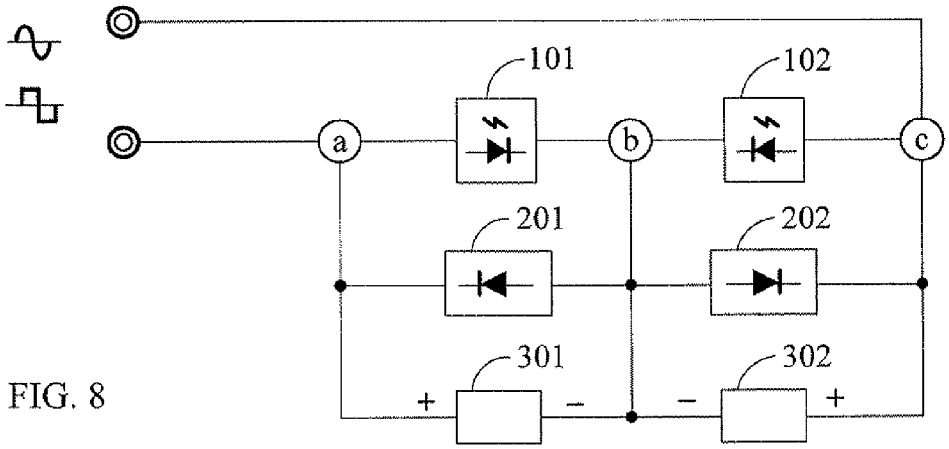
FIG. 8 is the operational circuit diagram of FIG. 6 wherein impedance elements are not installed.

FIG. 8 is the operational circuit diagram of FIG. 6 wherein impedance elements are not installed.

Figure 9:
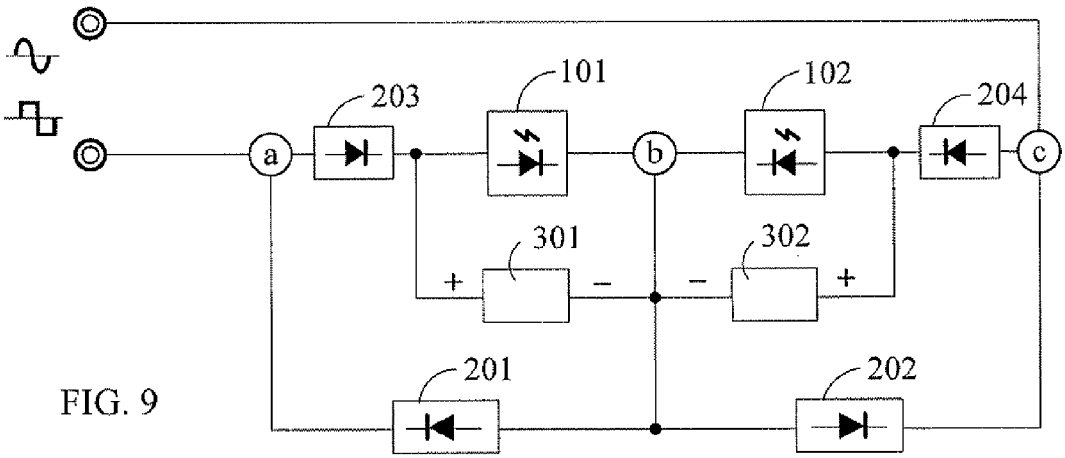
FIG. 9 is the operational circuit diagram of FIG. 7 wherein impedance elements are not installed.

FIG. 9 is the operational circuit diagram of FIG. 7 wherein impedance elements are not installed.

Figure 10:
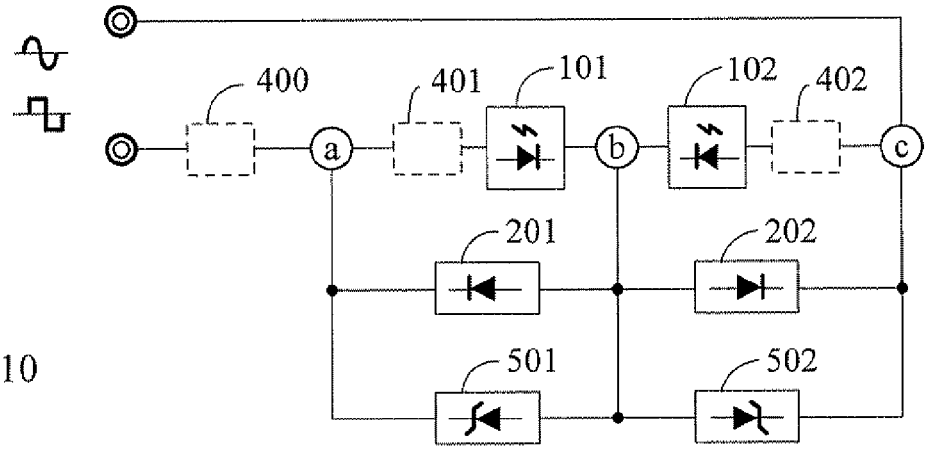
FIG. 10 is the operational circuit diagram of FIG. 4 wherein the voltage-limiting elements are connected in parallel with both terminals of the diodes.

When the reverse polarity series type LED and drive circuit are applied on the alternating current power, a voltage-limiting element (501) and/or voltage-limiting element (502) is/are connected in parallel to both terminals of diode (201) and/or diode (202) to form a voltage-limiting protection for the LED in conjunction with the installation of current-limiting impedance element (400) and/or current-limiting impedance element (401) and/or current-limiting impedance element (402). The voltage-limiting elements are consisted of zener diodes or electromechanical and electronic circuit devices with zener effects. FIG. 10 is the operational circuit diagram of FIG. 4 wherein the voltage-limiting elements are connected in parallel with both terminals of the diodes.

The reverse polarity series type LED and drive circuit further connect LED (201) and/or the both terminals of diode (202) in parallel with voltage-limiting element (501) and/or voltage-limiting element (502) to protect the LED and the power storing and discharging devices. Pertinent functions are shown in FIG. 4 to FIG. 9.

Figure 11:
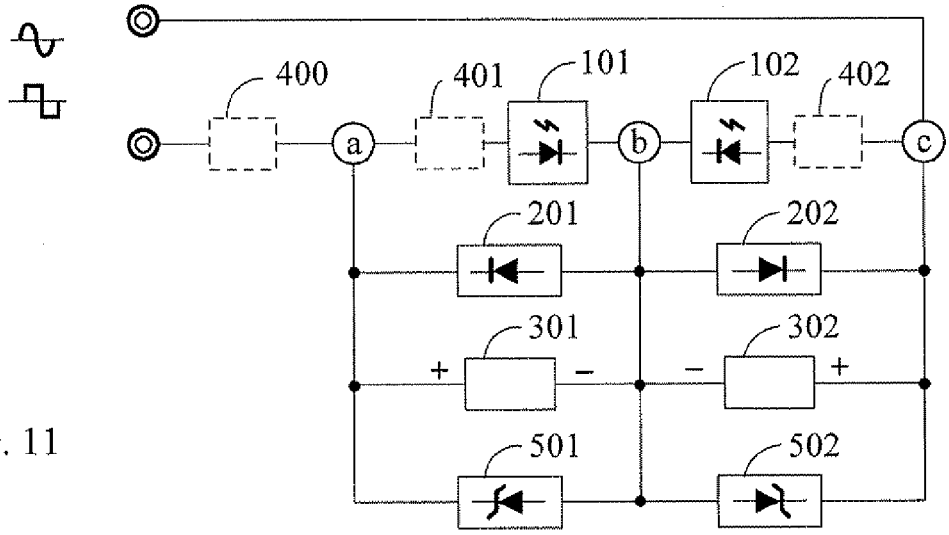
FIG. 11 is the operational circuit diagram of FIG. 6 wherein the voltage-limiting elements are connected in parallel with both terminals of the diodes.

FIG. 11 is the operational circuit diagram of FIG. 6 wherein the voltage-limiting elements are connected in parallel with both terminals of the diodes.

FIG. 11 shows the both terminals of diode (201) of the circuit in FIG. 6 further connected in parallel with the voltage-limiting element (501), and/or the both terminals of diode (202) is connected in parallel with voltage-limiting element (502).

Figure 12:
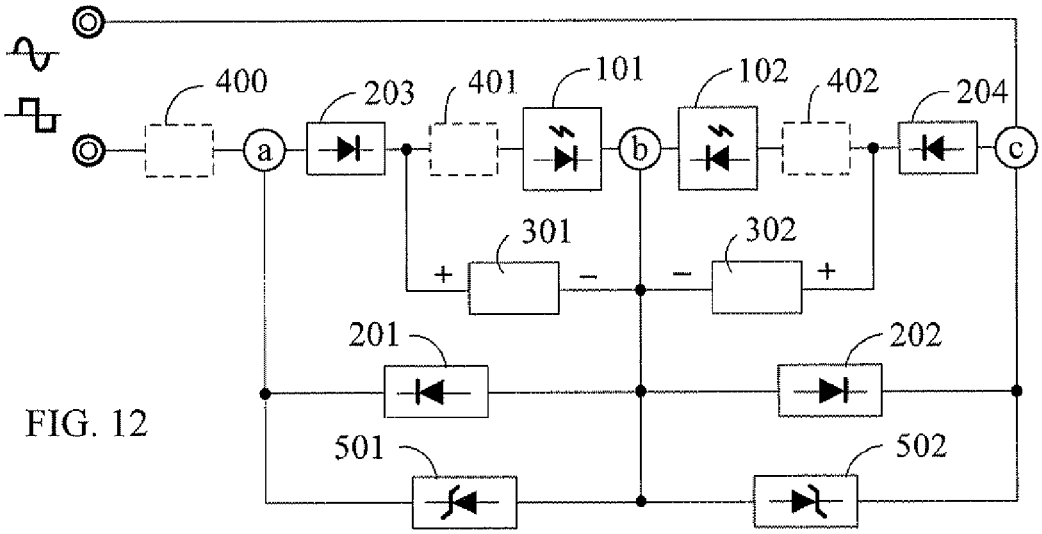
FIG. 12 is the operational circuit diagram of FIG. 7 wherein the voltage-limiting elements are connected in parallel with both terminals of the diodes.

FIG. 12 is the operational circuit diagram of FIG. 7 wherein the voltage-limiting elements are connected in parallel with both terminals of the diodes.

FIG. 12 shows the two terminals of diode (201) of the circuit in FIG. 7 further connected in parallel with the voltage-limiting element (501), and/or both terminals of diode (202) is connected in parallel with voltage-limiting element (502).

The reverse polarity series type LED and drive circuit as applied on the operational circuits shown in FIGS. 10, 11 and 12 wherein the voltage-limiting element (501) and/or voltage-limiting element (502) connected in parallel to both terminals of diode (201) and/or diode (202) are installed and connected in parallel with LED (101) and/or LED (102), or installed on both locations.

Figure 13:
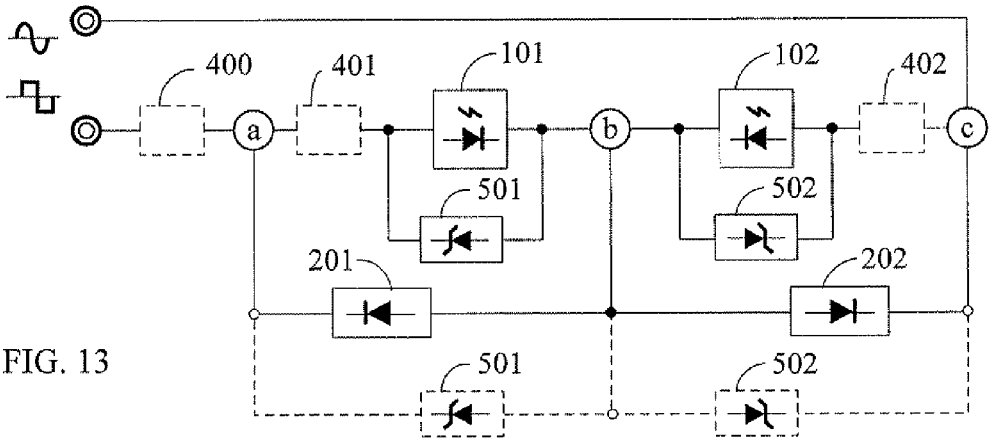
FIG. 13 is the circuit diagram of both terminals of the LEDs connected in parallel with the voltage-limiting elements in FIG. 10.

FIG. 13 is the circuit diagram of both terminals of the LEDs connected in parallel with the voltage-limiting elements in FIG. 10.

Figure 14:
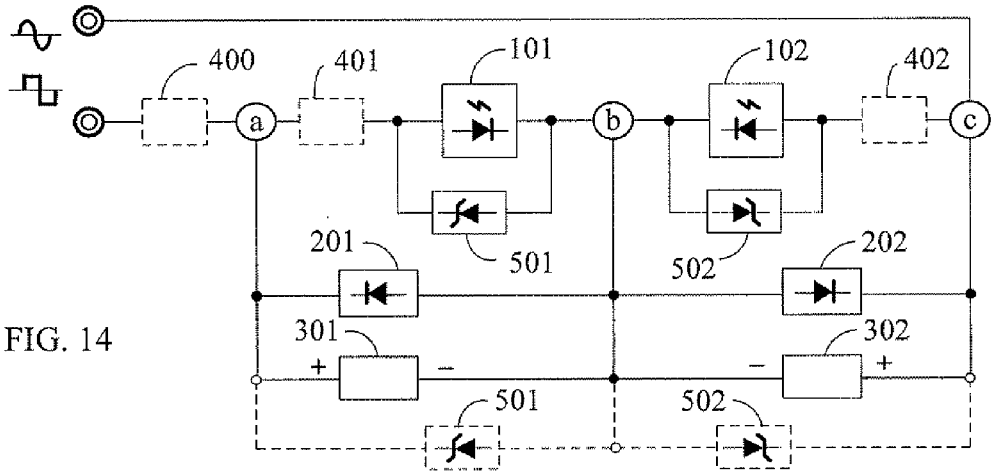
FIG. 14 is the circuit diagram of both terminals of the LEDs connected in parallel with the voltage-limiting elements in FIG. 11.

FIG. 14 is the circuit diagram of both terminals of the LEDs connected in parallel with the voltage-limiting elements in FIG. 11.

Figure 15:
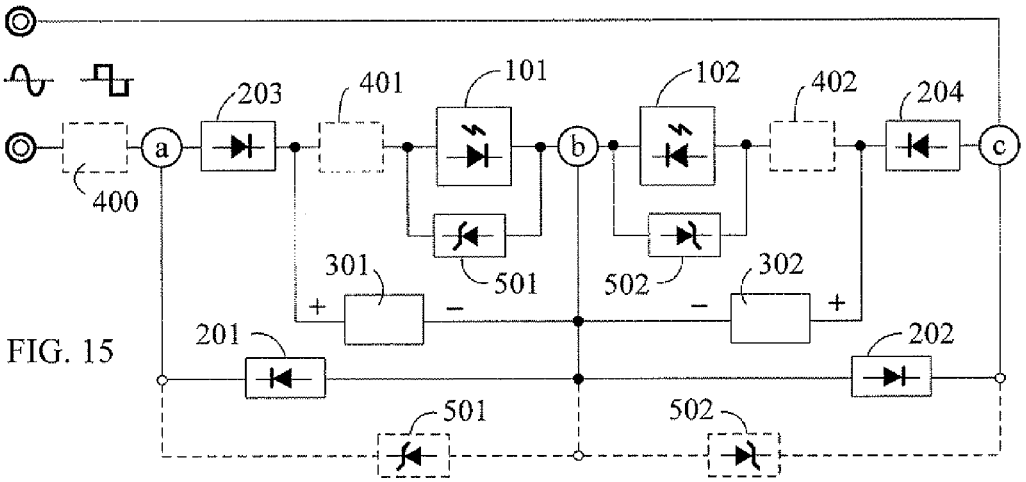
FIG. 15 is the circuit diagram of both terminals of the LEDs connected in parallel with the voltage-limiting elements in FIG. 12.

FIG. 15 is the circuit diagram of both terminals of the LEDs connected in parallel with the voltage-limiting elements in FIG. 12.

During actual applications, pertinent elements of the reverse polarity series type LED and drive circuit have the following options:

1) The specifications for power, voltages, currents and numbers as well as the series or parallel or series-parallel connections of LED (101) and LED (102) are the same with or different from each other;
2) The colors of lights emitted by the energized LED (101) and LED (102) are the same with or different from each other;
3) The types and specifications of the current-limiting element (400) and/or current-limiting element (401) and/or current-limiting element (402) are the same with or different from each other;
4) The current-limiting impedance element (400) and/or the current-limiting impedance element (401) and/or the current-limiting impedance (402) are fixed impedances and adjustable impedance values or clipping controlled or linear controlled in order to control LED light adjustments. This includes simultaneous or separate control of LED (101) and LED (102);

5) The types and specifications of the power storing and discharging device (301) and/or power storing and discharging device (302) are the same with or different from each other;

6) The types and specifications of the voltage-limiting element (501) and voltage-limiting element (502) are the same with or different from each other.

The invention claimed is:

1. A reverse polarity series type LED and drive circuit formed by two sets of LED and diode assemblies in reverse polarity series connection wherein a first set consists of at least one or multiple homopolar series or parallel connected or series and parallel connected LEDs, and a second set consists of at least one or more homopolar parallel or series connected or series and parallel connected LEDs for further connection to the drive circuit formed by current-limiting impedance and/or power storage and discharging devices and/or voltage-limit circuit devices in order to produce required operational characteristics, comprising:

a LED (101): formed by one or more luminous diodes in homopolar parallel or series connection or in series and parallel connection;

a LED (102): formed by one or more luminous diodes in homopolar parallel or series connection or in series and parallel connection;

diodes (201), (202): formed by one or more rectified diode or single way conductive circuit devices in parallel or series connection or in series and parallel connection; wherein:

by means of parallel connection between the LED (101) and the diode (201) in a reciprocal turn-on current direction, the first set of LED and diode assembly is formed, by means of the parallel connection between the LED (102) and the diode (202) in the reciprocal turn-on current direction, the second LED and diode assembly is formed;

by means of a reverse polarity series connection between the first LED and diode assembly with the second LED and diode assembly, a reverse polarity series type LED device is formed; an independent connection terminal of the first LED and diode assembly being designated as the (a) terminal, the reverse polarity series connection terminal between the first and the second LED and diode assemblies being designated as the (b) terminal, and an independent connection terminal of the second LED and diode assembly being designated as the (c) terminal, and wherein:

alternating current power is delivered from the (a) and (c) terminals of the reverse polarity series type LED, the reverse polarity series type LED device serves to perform the functions of the alternating current LED, a current-limiting impedance element (400) is series connected to the (a) or (c) terminals of the alternating current power and the reverse polarity series type LED and/or a current-limiting impedance element (401) is series connected to LED (101), and according to the direction of the light-emitting current of LED (101), and the current-limiting impedance element (401) is further connected in series with diode (203), then through the current input end of diode (203) and the current output terminal of LED (101), assumes a reverse current flow and connects in parallel with diode (201) and/or a current-limiting impedance element (402) is series-connected to LED (102), and according to the direction of light-emitting current of LED (102), the current-limiting impedance element (401) is connected in series to diode (204), and then through the current input terminal of diode (204) and the current output terminal of LED (102), assumes a reverse current flow and connects in parallel with diode (202), a power storing and discharging device (301) is connected in parallel between the joint connecting diode (203) and the current-limiting impedance element (401) and the current output terminal of LED (101), and/or a power storing and discharging device (302) is connected in parallel between the joint connecting diode (204) and current-limiting impedance element (402) and the current output terminal of LED (102), wherein polarities of the alternating current power supply during the delivery of alternating current power are such that it assumes a power supply status with respect to the LED with which they are connected in parallel and when the power supply voltage is higher than the voltage of its parallel-connected power storing and discharging device, the power source simultaneously supplying power to the LED and charges the power storing and discharging device with which it is connected in parallel, and wherein the polarities of the alternating current power supply are such that it does not supply power to its parallel-connected LED when the power supply voltage is lower than the voltage of the power storing and discharging device, the power storing and discharging device instead supplying the power to the LED with which it is connected in parallel, by means of the operation of the power storing and discharging device, the following partial or complete functions are attained: 1) two LEDs deliver power and emit light without being affected by the polarity changes of the alternating current power source; 2) when alternating current power is driving the LED, optical pulsation of the LED is reduced; 3) the power storing and discharging devices supply electric energy to the LEDs when power is cut off; and 4) the power storing and discharging devices allow continuous lighting of LEDs during an emergency power shutdown, and the power storing and discharging device consists of a rechargeable battery or a monopolar or bipolar capacitance or super capacitance.

2. The reverse polarity series type LED and drive circuit as claimed in claim 1, wherein the (a) and (c) terminals of the reverse polarity series type LED are connected to each other, their connection terminal and (b) terminal serve to commonly allow direct current to pass through LED (101) and LED (102) so that the reverse polarity series type LED device serves to perform the functions of a direct current LED.

3. The reverse polarity series type LED and drive circuit as claimed in claim 1, wherein a current-limiting impedance element (400) is series-connected to the (a) or (c) terminals of the alternating current power and the reverse polarity series type LED and/or a current-limiting impedance element (401) is series connected to LED (101) and/or a current-limiting impedance element (402) is series-connected to the LED (102); wherein the impedance elements are formed by one or more impedance element types including: 1) a resistive impedance element; 2) a conductive impedance elements; 3) inductive impedance elements; 4) linear transistor impedance elements; 5) clipping on-off type elements formed by solid on-off type elements; 6) thyristor clipping on-off elements; and the series positions of the impedance elements include: 1) the impedance element is connected in series with individual LED after which it connects in parallel with diodes; and/or 2) the impedance element is connected in series between the power source and the reverse polarity series type LED; and/or 3) the LED connects to the diode in parallel and then connects to the impedance element in series.

4. The reverse polarity series type LED and drive circuit as claimed in claim 1 wherein the current-limiting impedance element (400) and/or the current-limiting impedance element (401) and/or current-limiting impedance element (402) are optionally installed.

5. The reverse polarity series type LED and drive circuit as claimed in claim 3, wherein a voltage-limiting element (501) and/or voltage-limiting element (502) are connected in parallel to both terminals of diode (201) and/or diode (202) to form a voltage-limiting protection for the LED in conjunction with the installation of current-limiting impedance element (400) and/or current-limiting impedance element (401) and/or current-limiting impedance element (402), the voltage-limiting elements consisting of zener diodes or electromechanical and electronic circuit devices with zener effects.

6. The reverse polarity series type LED and drive circuit as claimed in claim 1 wherein both terminals of diode (201) are connected in parallel with voltage-limiting element (501) and/or both terminals of diode (202) are connected in parallel with voltage-limiting element (502).

7. The reverse polarity series type LED and drive circuit as claimed in claim 1 wherein the voltage-limiting element (501) and/or voltage-limiting element (502) connected in parallel to both terminals of diode (201) and/or diode (202) are installed and connected in parallel with LED (101) and/or LED (102), or installed on both locations.

8. The reverse polarity series type LED and drive circuit as claimed in claim 1, wherein the specifications for power, voltages, currents and numbers as well as the series or parallel or series-parallel connections of LED (101) and LED (102) are the same as or different from each other; and the colors of lights emitted by the energized LED (101) and LED (102) are the same as or different from each other.

9. The reverse polarity series type LED and drive circuit as claimed in claim 1, 3, 4, 6 or 7, wherein the types and specifications of the current-limiting element (400) and/or current-limiting element (401) and/or current-limiting element (402) are the same as or different from each other; the current-limiting impedance element (400) and/or the current-limiting impedance element (401) and/or the current-limiting impedance (402) is/are fixed impedances and adjustable impedance values or clipping controlled or linear controlled in order to control LED light adjustments, including simultaneous or separate control of LED (101) and LED (102).

10. The reverse polarity series type LED and drive circuit as claimed in claim 1, 4, 6 or 7, wherein the types and specifications of the power storing and discharging device (301) and/or the power storing and discharging device (302) are the same as or different from each other.

11. The reverse polarity series type LED and drive circuit as claimed in claim 6 or 7, wherein the types and specifications of the voltage-limiting element (501) and/or voltage-limiting element (502) are the same as or different from each other.

* * * * *